United States Patent [19]

Moor

[11] Patent Number: 4,961,596

[45] Date of Patent: Oct. 9, 1990

[54] BINDER POUCH

[75] Inventor: Marc L. Moor, Dayton, Ohio

[73] Assignee: The Mead Corporation, Dayton, Ohio

[21] Appl. No.: 351,366

[22] Filed: May 15, 1989

[51] Int. Cl.[5] ..... B42D 3/00

[52] U.S. Cl. ..... 281/15.1; 281/30; 281/31; 281/51; 206/214

[58] Field of Search ..... 281/15.1, 29, 30, 31, 281/51, 42, 45; 206/214, 232; D19/27, 32; D3/30.1, 31, 32, 71, 106

[56] References Cited

U.S. PATENT DOCUMENTS

| | | | |
|---|---|---|---|
| D. 101,439 | 10/1936 | Doppelt | D3/71 |
| D. 238,725 | 2/1976 | Zerobnick | D3/71 |
| 1,218,849 | 3/1917 | Frederickson | 206/81 |
| 1,531,539 | 3/1925 | Buedall | 206/214 |
| 2,318,192 | 5/1943 | Boelema | 281/31 |
| 2,677,376 | 5/1954 | Brunner | 281/29 |
| 3,564,665 | 2/1971 | Kirk | 24/81 |
| 4,296,945 | 10/1981 | Pavlik | 281/31 |
| 4,512,603 | 4/1985 | Williams | 281/45 |
| 4,555,018 | 11/1985 | Cho | 206/214 |
| 4,555,128 | 11/1985 | White et al. | 281/45 |
| 4,838,724 | 6/1989 | Spence | 281/31 |

*Primary Examiner*—Paul A. Bell
*Assistant Examiner*—Hwei-Siu Payer
*Attorney, Agent, or Firm*—Biebel, French & Nauman

[57] ABSTRACT

A binder pouch is provided for use in conjunction with a binder or portfolio. The binder pouch includes a deformable storage unit having a top with separable first and second panels and a zipper, and a sidewall. The binder pouch also includes a strap fabricated at least in part from an elastomeric material. Preferably, the first and second panels are of a first color or design, the sidewall is of a second color or design and the strap is of yet a third color or design. The storage unit has a bottom surface preferably comprised of a portion of the strap. The sidewall is fixedly secured to the strap about the entire periphery of the sidewall. The storage unit is of a generally rectangular shape and is formed by a plurality of flaps on the top and sidewall which are secured to one another by stitches. The periphery of the top is less than the periphery of the sidewall, at the point where the sidewall is fixedly secured to the strap.

3 Claims, 3 Drawing Sheets

BINDER POUCH

BACKGROUND OF THE INVENTION

The present invention relates generally to pouches and the like, and more particularly, to such a device for attachment to a binder or portfolio.

The difficulty of carrying or storing pencils, pens, and other school/business accessories in a ring binder, portfolio, or the like has been recognized for many years. The terms "portfolio" and "binder" may be used interchangeably herein with the understanding that "binder" refers generically to hinged folders whether or not binder rings are provided. One solution to the storage problem is disclosed in U.S. Pat. No. 1,218,849 wherein a receptacle provided with a hinged lid and a clamp for attaching the receptacle to the object is provided. Another approach is disclosed in U.S. Pat. No. 4,555,018, wherein a folder type pencil case having an adhesive panel strip is provided which permits the pencil case to be adhesively secured to the cover of a book or notebook.

Another approach is the providing of two flat pieces of heat sealed vinyl which affixes to binder rings using holes punched in the vinyl product. Since the product is constructed of two flat pieces of vinyl, the holding capacity is very limited. Additionally, durability is sacrificed especially with respect to the area surrounding the punched holes. Finally, the width of the flat pieces of vinyl cause some of the items in this type of product to be located far enough away from the binder rings such that the pouch is contacted by the inside cover of the binder, thereby posing the threat of scratching or nicking of the pouch as a result of the cover putting pressure on the items contained in the pouch.

Unfortunately, the inadvertent opening of the top panel in the Frederickson patent would encourage spillage of excess contents. In addition, the planar surfaces which are indicated in the drawing as being fabricated from metal do not permit the holder to be compressed while in use, and in fact furnish sharp points of contact which could scratch or dent other books or items carried atop the holder. In the Cho patent, the folder relies on friction fit engagement with the pens and pencils designed to be contained therein for the retaining of such pens and pencils.

It is thus apparent that the need exists for an improved binder pouch or the like which provides for the secure storage of pencils, pens and other accessories with little likelihood of loss from the pouch and which provides a holder which does not scratch or dent items which come into contact with it.

SUMMARY OF THE INVENTION

The problems associated with the prior binder pouches are overcome in accordance with the present invention by forming a binder pouch for attachment to a binder having a front and back cover, the binder pouch comprising retention means and a deformable storage unit. The retention means preferably is formed from a strap capable of encircling a cover of the binder, thereby permitting the binder pouch to be removably attached to the binder. The deformable storage unit has a top, a sidewall, and a bottom surface. The top has at least one panel member and closure means, with the sidewall being attached to the top, as well as to the bottom surface. Preferably the retention means also forms the bottom surface of the binder pouch. Furthermore, in the preferred embodiment, the pouch is of a rectangular configuration, the storage unit is fabricated from a fabric material, and the retention means is fabricated from an elastomeric material.

In the preferred embodiment, the top is comprised of at least two panel members capable of being detachably secured to one another by the closure means. Additionally, the top, sidewall, closure means and retention means are preferably fabricated from material of at least three distinct color or designs. Preferably the top is of a first color or design, the sidewall is of a second color or design, and the retention means is of a third color or design. The sidewall has a sidewall top flap and a sidewall bottom flap, with the sidewall bottom flap laying adjacent to the bottom surface. The top also has a top panel peripheral flap and a top panel closure flap.

The binder pouch of this invention may be oriented adjacent either the inwardly or outwardly facing sides of either the front or back covers of a binder. Additionally, due to the type of retention means utilized in the invention, the storage unit may be oriented at the most advantageous spot along the width of the cover.

It is a primary object of the present invention to provide a binder pouch which is conveniently and inexpensively formed, yet which provides secure storage of pencils, pens and other accessories adjacent at least one cover of a binder.

Another object of the present invention is to provide a binder pouch of such a striking appearance as to become a fashionable and almost necessary adjunct to a binder given peer relationships.

Other objects and advantages of the invention will be apparent from the following description, the accompanying drawings, and the appended claims.

DETAILED DESCRIPTION OF THE INVENTION

Figure 1:
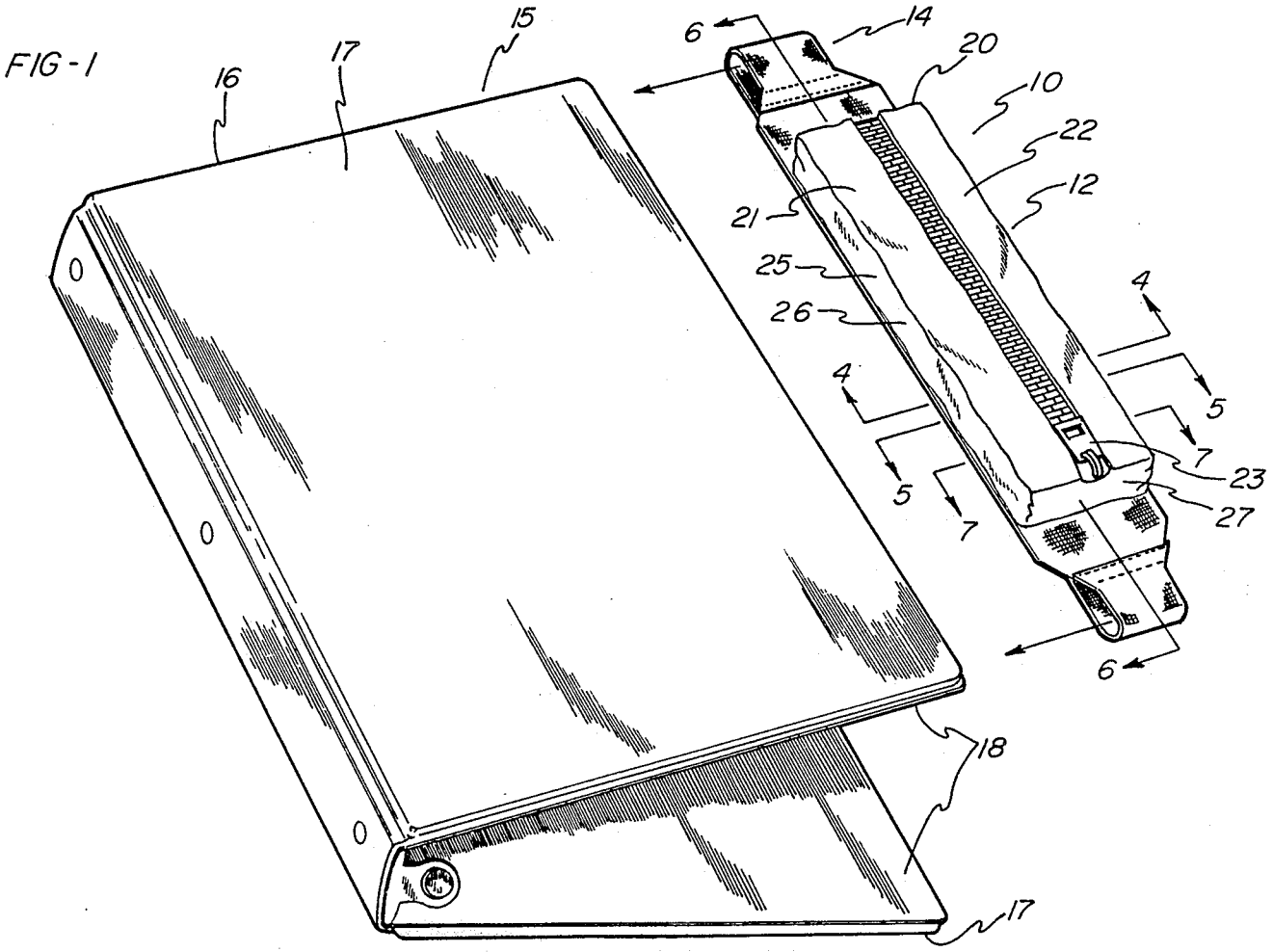
FIG. 1 is a perspective view of a binder pouch in accordance with the present invention shown about to be positioned in operative relationship about a binder cover.
Figure 4:
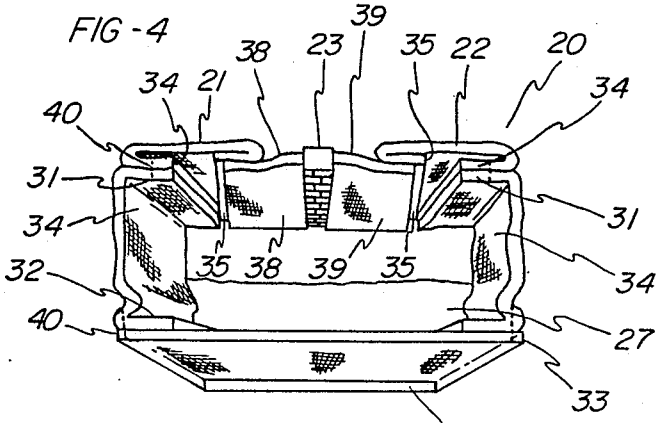
FIG. 4 is a vertical sectional view on an enlarged scale taken along line 4-4 of FIG. 1.
Figure 5:
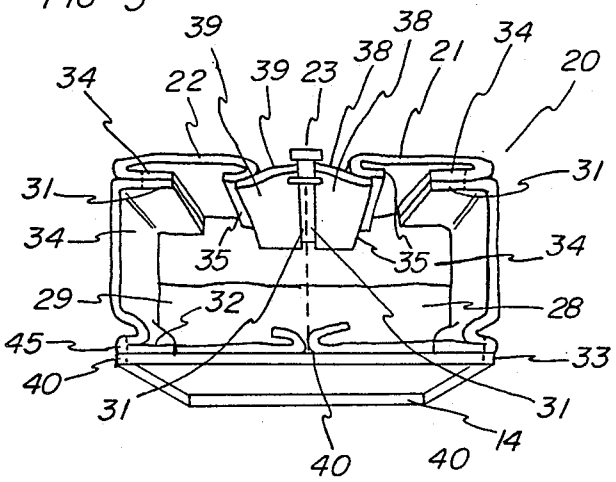
FIG. 5 is a vertical sectional view on an enlarged scale taken along line 5-5 of FIG. 1.
Figure 2:
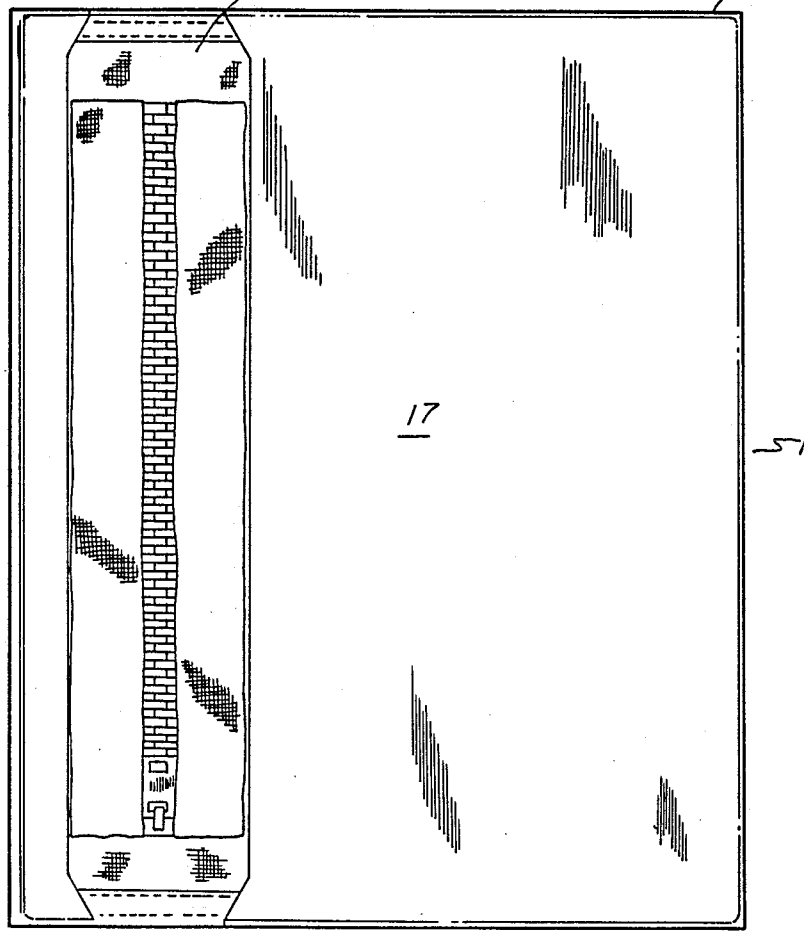
FIG. 2 is a top plan view of a binder cover with the invention installed in operative relationship therewith.
Figure 3:
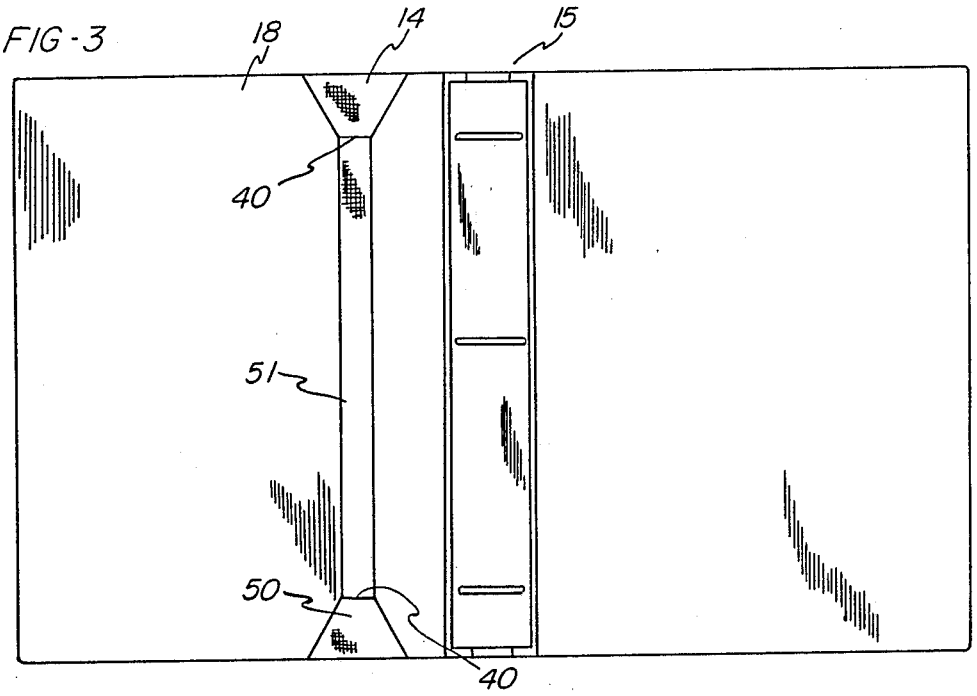
FIG. 3 is a top plan view of a binder cover when opened having installed thereon the present invention.
Figure 6:
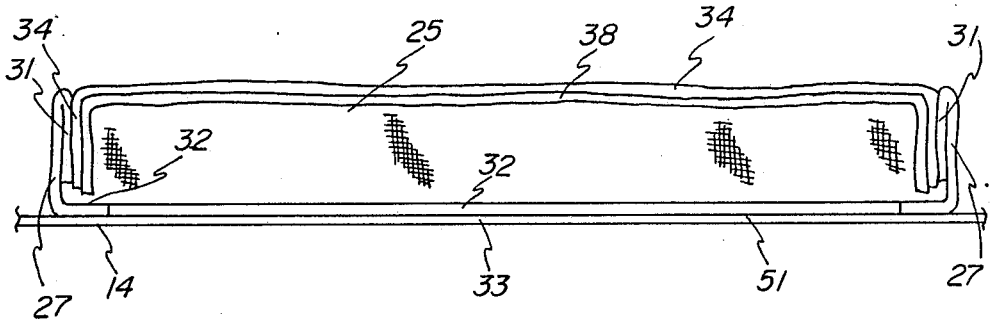
FIG. 6 is a vertical sectional view on an enlarged scale taken along line 6-6 of FIG. 1.
Figure 7:
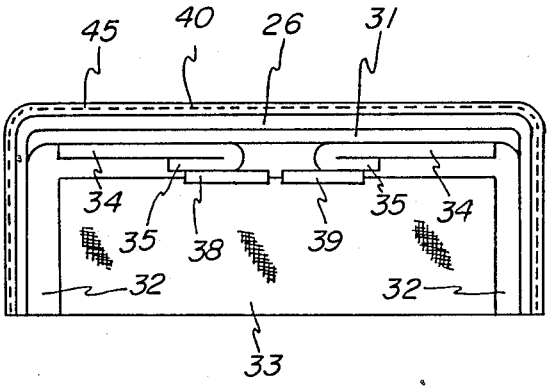
FIG. 7 is a horizontal sectional view on an enlarged scale taken along line 7-7 of FIG. 1.

Having reference to the drawings, attention is first directed to FIG. 1 which discloses a binder pouch embodying this invention positioned for installation in operative relationship about a cover of a binder, the binder pouch being designated generally by the numeral 10. The binder pouch has as its primary components a storage unit 12 and retention means 14. The binder pouch 10 is shown as it is about to be installed in operative relationship on a binder 15, wherein the retention means 14 encircles one of the covers 16 of the binder 15. As can be seen in FIGS. 1, 2, and 3, the binder 15 has front and rear covers with an outwardly facing side 17 and inwardly facing side 18.

As can be seen in FIGS. 4, 5, 6, and 7, the storage unit comprises a top 20 having a first panel member 21 and second panel member 22. Preferably each panel member is secured to a portion of closure means 23, such that they are capable of being detachably secured to one another by means of the closure means 23. While the preferred closure means 23 includes a zipper, other fastening means such as VELCRO or a mechanically interengaging channel means could be used. The closure means would preclude the inadvertent opening of the storage unit, such opening often causing the contents to be spilled.

The storage unit also is comprised of a sidewall 25, which preferably is formed from a single sheet of fabric such that side panels 26 and end panels 27 are formed from a continuous sheet. The sheet has a seam line on one of the end panels 27 such that a first section 28 and second section 29 of that particular end panel is formed. Viewed from the inside, or interior, of the storage unit 12, the sidewall 25 has a sidewall top flap 31, and sidewall bottom flap 32, with the sidewall bottom flap 32 laying adjacent to bottom surface 33 of storage unit 12. Preferably bottom surface 33 is formed from a portion of the retention means 14.

The top 20 is shown as having an inwardly folded top panel peripheral flap 34 and top panel closure flap 35. The top panel peripheral flap 34 extends along the sidewall 25 and serves to form the periphery of the top 20 along the side panels 26 and end panels 27. The to panel closure flap 35 lies adjacent to and preferably on top of closure means 23. The portion of the closure means folded along end panels 27 forms first closure flap 38, and second closure flap 39 which are secured to the top panel closure flap 35. The foot portion 45 of the sidewall 25 is fixedly secured to the bottom surface 33 of retention means 14 about the entire periphery of the sidewall 25. The securing together of the various flaps and panel sections of this invention is preferably done by means of stitching 40, although other methods of fastening such as adhesives could be used.

The retention means 14 preferably has a portion thereof formed from an elastomeric strap. The entire strap may be fabricated from an elastomeric material or the strap may have a first portion 50 which is lacking in elastomeric properties, with the elasticity of the retention means being provided by a strap second portion 51. The retention means permits the binder pouch not only to be removably attached to the binder, but also permits the storage unit to be positioned at an advantageous spot along the width of the cover.

Preferably the binder pouch of this invention is fabricated from a fabric similar to nylon, such that the storage unit is deformable when in use. As can be seen in this embodiment, the storage unit is generally rectangular. Additionally, the width associated with the top panel 20 may be slightly less than the width associated with the bottom of the end panels 27, just as the length associated with the top 20 may be slightly less than the length associated with the bottom of the side panels 26, to offer a more visually attractive binder pouch, as will be discussed in greater detail below.

Preferably the binder pouch and strap of this invention are fabricated from at least four distinct colors or fabric designs with the top 20 having a first color or design associated therewith, the sidewall having a second color or design associated therewith, and the retention means having a third color or design associated therewith. Preferably the closure means 23 has a fourth color or design associated therewith. The variety of designs thus gives the binder pouch a striking appearance with a multiplicity of potential color/design combinations available. The possibility of choosing such a visually distinctive binder pouch given the various colors and fabric designs, will provide the user of the unit with a means for expressing himself, while at the same time reinforcing self-identification and self-worth, given the fact that the primary anticipated users of this product will be children or young adults.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. On a binder comprising interconnected front and rear covers each having an outwardly facing side and an inwardly facing side and each having a pair of opposed parallel ends, a binder pouch encirclenly attached to one of said covers for storing writing accessories, said binder pouch comprising an elastic strap stretched around said ends of said one cover and extending therebetween along the inwardly facing side of said cover, and a deformable storage unit secured to said strap adjacent the outwardly facing side of said cover; said storage unit being provided with an access opening for entry of the writing accessories and closure means for selectively opening and closing said access opening means.

2. An article as claimed in claim 1 wherein said storage unit comprises a sidewall secured to said strap and a pair of elongated top panels secured to said sidewall remote from said strap, said access opening being defined by a gap between said top panels.

3. An article as claimed in claim 2 wherein said closure means comprises a zipper.

* * * * *